US007069141B2

(12) United States Patent
Kunz et al.

(10) Patent No.: US 7,069,141 B2
(45) Date of Patent: Jun. 27, 2006

(54) METHOD FOR DETERMINING THE OIL TEMPERATURE IN AN INTERNAL COMBUSTION ENGINE

(75) Inventors: Franz Kunz, Altmannstein (DE); Hong Zhang, Tegernheim (DE)

(73) Assignee: Siemens Aktiengesellschaft, München (DE)

( * ) Notice: Subject to any disclaimer, the term of this patent is extended or adjusted under 35 U.S.C. 154(b) by 342 days.

(21) Appl. No.: 10/475,736

(22) PCT Filed: Apr. 4, 2002

(86) PCT No.: PCT/DE02/01231

§ 371 (c)(1),
(2), (4) Date: Oct. 23, 2003

(87) PCT Pub. No.: WO02/086296

PCT Pub. Date: Oct. 31, 2002

(65) Prior Publication Data

US 2004/0128059 A1 Jul. 1, 2004

(30) Foreign Application Priority Data

Apr. 23, 2001 (DE) ..... 101 19 786

(51) Int. Cl.
*F01M 5/00* (2006.01)

(52) U.S. Cl. ..... 701/114; 701/102; 701/115

(58) Field of Classification Search ..... 701/114, 701/101, 115, 102, 30, 29
See application file for complete search history.

(56) References Cited

U.S. PATENT DOCUMENTS

| | | | | |
|---|---|---|---|---|
| 4,708,111 A | * | 11/1987 | Shiozaki et al. | 123/494 |
| 4,847,768 A | | 7/1989 | Schwartz et al. | |
| 5,002,026 A | | 3/1991 | Ohkumo et al. | |
| 5,623,902 A | | 4/1997 | Nusser et al. | |
| 5,633,796 A | | 5/1997 | Cullen et al. | |
| 5,920,617 A | | 7/1999 | Berger et al. | |
| 6,246,950 B1 | * | 6/2001 | Bessler et al. | 701/29 |

FOREIGN PATENT DOCUMENTS

| | | |
|---|---|---|
| DE | 40 16 099 C2 | 11/1990 |
| DE | 44 33 299 A1 | 3/1996 |
| DE | 196 34 368 A1 | 3/1998 |
| DE | 199 61 118 A1 | 7/2001 |
| DE | 100 06 533 A1 | 10/2001 |

* cited by examiner

*Primary Examiner*—Hieu T. Vo
(74) *Attorney, Agent, or Firm*—Cohen, Pontani, Lieberman & Pavane

(57) ABSTRACT

The oil temperature in the internal combustion engine is calculated using an oil temperature model, which draws upon at least one parameter that characterizes the operating point of the internal combustion engine. The differential value between the modeled temperature value of the oil temperature model and the measured temperature value of the oil, which is measured by the oil temperature sensor, is included as an input variable in the oil temperature model during an iterative calculation cycle of an oil temperature value of the oil temperature mode, said calculation cycle directly or indirectly following the method step involving the calculation of the differential value.

6 Claims, 3 Drawing Sheets

METHOD FOR DETERMINING THE OIL TEMPERATURE IN AN INTERNAL COMBUSTION ENGINE

PRIORITY CLAIM

This is a U.S. national stage of application No. PCT/DE02/01231, filed on 04 Apr. 2002. Priority is claimed on that application and on the following application(s): Country: Germany, Application No.: 101 19 786.1, Filed: 23 Apr. 2001.

BACKGROUND OF THE INVENTION

1. Field of the Invention

The invention relates to a method for determining the oil temperature in an internal combustion engine.

2. Description of the Prior Art

The current temperature of the engine oil is required for certain functions in an electronic control system for internal combustion engines. For example, the exceeding of a threshold value for the oil temperature of the engine can be used to trigger on-board diagnostics. Another known use of the oil temperature is as a criterion for adjusting the idling speed of an internal combustion engine, as at very high oil temperatures a higher idling speed is necessary in order to provide the internal combustion engine with an adequate supply of the then low-viscosity oil. The oil temperature can additionally be used for oil lifetime calculations, enabling the time for an oil change to be optimally determined.

For all these purposes, the known procedure is to measure the oil temperature using an oil temperature sensor and to process the oil temperature sensor signal in the appropriate manner. However, determining the oil temperature by means of the oil temperature sensor is very inaccurate, particularly in the warm-up phase of the oil when the internal combustion engine is not at normal operating temperature.

U.S. Pat. No. 5,002,026 discloses how the oil temperature can be used to adjust the idling in the normal operating range of an internal combustion engine, the oil temperature being determined from other variables in order to obviate the need for an oil temperature sensor. For this purpose, the period of time during which the coolant temperature is equal to or greater than a temperature threshold value is determined. A predefined relationship between this period of time and the oil temperature is determined as a measure for the oil temperature and the idling speed is adjusted accordingly.

Another method for adjusting the idling of an internal combustion engine is known from U.S. Pat. No. 5,623,902 wherein overheating of an internal combustion engine necessitating an increase in the idling speed is detected when an oil temperature equivalent variable determined as a function of the coolant temperature, intake air temperature, engine speed and load of an internal combustion engine exceeds a threshold value.

However, all these methods are unable to provide a precise value for the oil temperature. They are merely designed to detect when the oil temperature exceeds a threshold value.

SUMMARY OF THE INVENTION

The object of the invention is to create a method enabling an oil temperature in an internal combustion engine to be determined with a high degree of accuracy.

In a method for determining the oil temperature in an internal combustion engine for a motor vehicle, the oil temperature is calculated by means of an oil temperature model. One or more parameters characterizing the operating point of the internal combustion engine are incorporated in the calculation as input variables for the oil temperature model.

According to the invention, a modeled oil temperature sensor value of the oil temperature model is compared with a measured oil temperature value and the difference between these two oil temperatures is included in the oil temperature model as an input variable for a directly or indirectly following iterative calculation cycle of another oil temperature value of the oil temperature model.

This enables the oil temperature in the internal combustion engine to be determined with a relatively high degree of accuracy.

The difference between the modeled oil temperature sensor value and the measured oil temperature may be additively or multiplicatively included in the oil temperature model.

This enables the oil temperature sensor value of the model to be rapidly approximated to the oil temperature value of the sensor by suitable selection of the mathematical computation rule with which the differential value is incorporated in the oil temperature model and therefore means that fewer calculation cycles are necessary in the model for a sufficiently accurate approximation of the two oil temperature values.

First and a second temperature threshold values may be specified such that, if the temperature exceeds the first or is below the second threshold value, an oil temperature sensor malfunction is detected.

This can prevent oil temperature values from being included in further calculation cycles of the oil temperature model as input variables yielding incorrect results due to a defective sensor.

No value for the oil temperature is normally present at startup of the internal combustion engine. In such cases it is advantageous to take the current coolant temperature as the starting value. The warming-up of an internal combustion engine can be particularly accurately simulated by more or less heavily low-pass filtering the coolant temperature gradient over time depending on the absolute value of the coolant temperature while the internal combustion engine is not yet at normal running temperature. The low-pass filtering will be explained in greater detail below in the course of describing the exemplary embodiment.

Alternatively, if no valid coolant temperature value is available, e.g. because the relevant sensor has been found to be defective, it can always be calculated in a model stage provided for the internal combustion engine at normal running temperature in order to model the oil temperature.

The method according to the invention is just as suitable for internal combustion engines with a heat exchanger between oil and coolant circuit as for internal combustion engines not having a heat exchanger of this kind, as there is always a degree of thermal coupling between oil and coolant.

BRIEF DESCRIPTION OF THE DRAWINGS

The invention will now be explained in greater detail using an exemplary embodiment with reference to the accompanying drawings.

DETAILED DESCRIPTION OF THE PRESENTLY PREFERRED EMBODIMENTS

Figure 1:
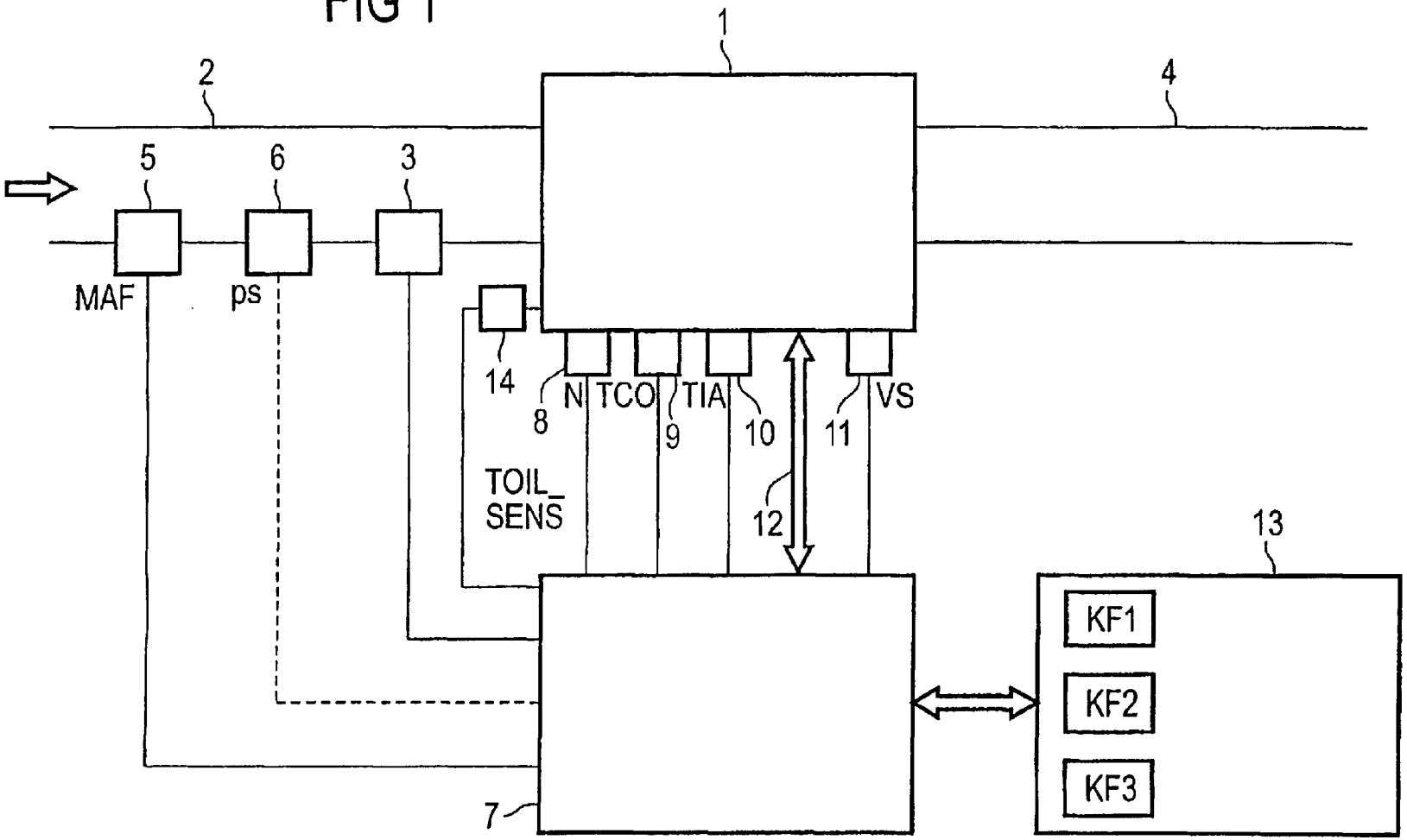
FIG. 1 is a schematic representation of an internal combustion engine employing the method according to the invention.

FIG. 1 is a very simplified representation of an internal combustion engine with control unit, only the parts necessary for understanding the invention being illustrated.

The internal combustion engine 1 preferably used as the propulsion source for a motor vehicle is supplied with the air necessary for combustion via an intake manifold 2. An injection system 3 injects fuel into the intake manifold 2. However, the method according to the invention can also be used for an internal combustion engine with fuel direct injection having, for example, a high-pressure reservoir (common rail) injection system with injection valves which spray the fuel directly into the cylinders of the internal combustion engine 1. The exhaust gas of the internal combustion engine 1 flows via an exhaust manifold 4 to an exhaust treatment system and from there to the open air via a muffler (not shown).

In the intake manifold 2 there is provided a load sensor in the form of an air mass sensor 5 which produces a signal MAF corresponding to the air mass flow. Alternatively, a pressure sensor 6 which measures the pressure ps obtaining in the intake manifold 2 can also be used as load sensor for the internal combustion engine 1. This is illustrated by the dashed line in FIG. 1.

For lean burn internal combustion engines where the fuel is directly injected, a different load-characterizing variable such as the mass of fuel injected can of course be selected.

An electronic control device 7 is provided for controlling and regulating the internal combustion engine 1. As electronic control devices of this kind, which generally incorporate a microprocessor and perform a large number of functions in addition to ignition control and fuel injection, are known in their own right, the following description will only go into the details of their design in so far as is relevant to the present invention and its operation. The signals from the various sensors are fed to the control device 7 for further processing. In particular there is provided a sensor 8 for the engine speed N, a sensor 9 for the coolant temperature TCO of the internal combustion engine 1, a sensor 10 for the intake air temperature TIA and a sensor 11 for the vehicle velocity vs. The control device 7 is connected to still further sensors and actuators of the internal combustion engine 1 via a data and control line 12 (schematically illustrated only).

The control device 7 is assigned a memory device 13 to which it is connected via a data bus (not specified in detail). The oil temperature TOIL in the internal combustion engine 1 is measured by means of an oil temperature sensor 14.

Figure 2:
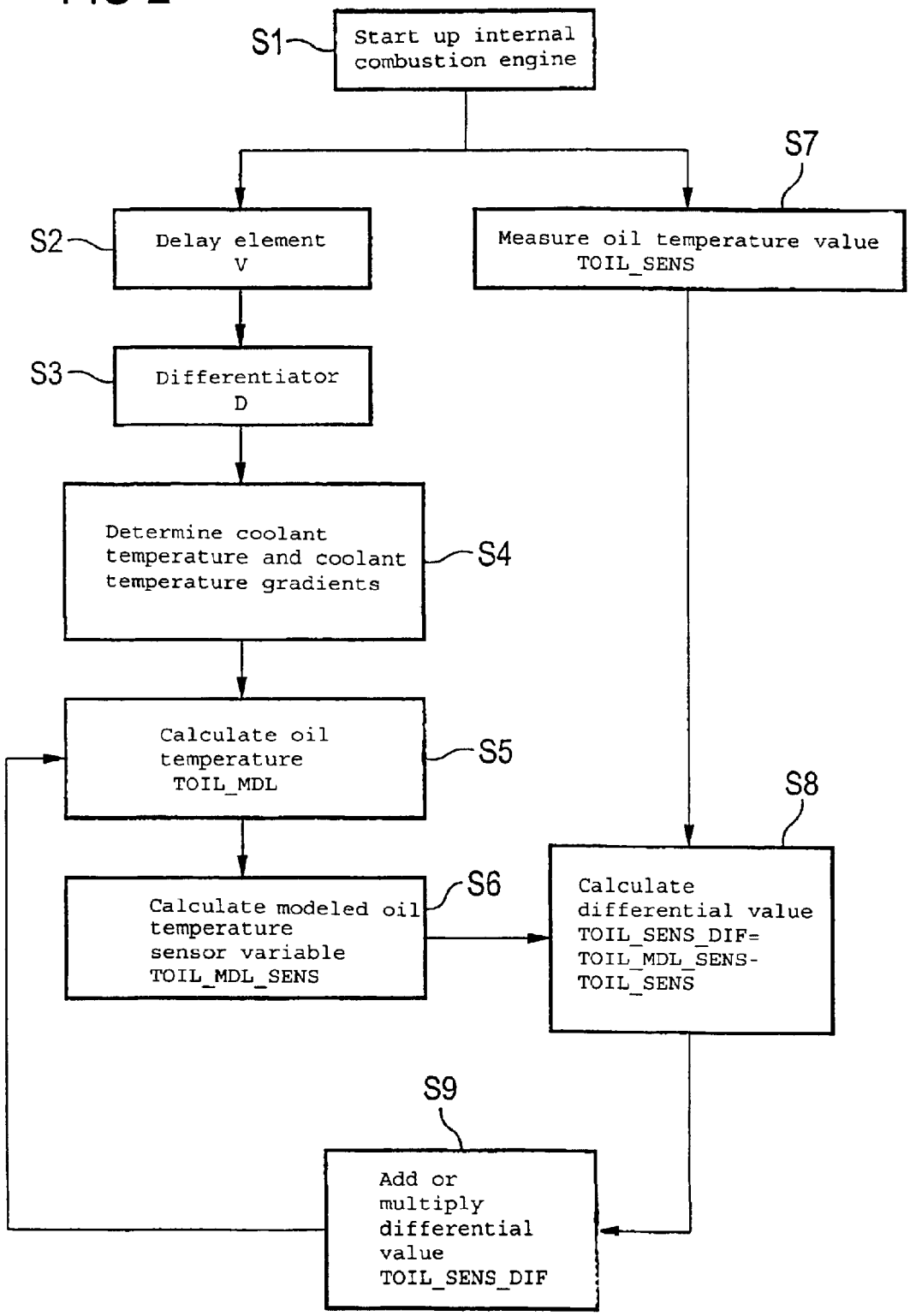
FIG. 2 is a flowchart for determining the oil temperature.

If the internal combustion engine is started up as per step S1 (FIG. 2), no value is normally available for the oil temperature TOIL, as the internal combustion engine 1 (FIG. 1) is not yet at normal running temperature. At the start of the process, therefore, the coolant temperature TCO is initially read out. When the coolant temperature TCO exceeds a certain threshold value of e.g. 80° C., the internal combustion engine is assumed to have reached a largely normal running temperature.

If the coolant temperature TCO is below its threshold value, the coolant temperature TCO is first fed to a delay element V (not shown) as per step S2. This delay element V delays the outputting of the input value by a specifiable time duration of e.g. 15 seconds. The output of the delay element V is transferred to a differentiator (not shown) as per step S3. In the differentiator, a differential value between the current coolant temperature TCO and the value produced by the delay element V is calculated. This means that the variation in the coolant temperature TCO as a function of the time duration specified in the delay element is obtained at the differentiator output.

This variation in the coolant temperature TCO, i.e. the gradient of the coolant temperature TCO, is determined as per step S4 and fed to a low-pass filter (not shown). The low-pass filter performs low-pass filtering of the coolant temperature gradient TCO, an oil temperature gradient value being produced at the low-pass filter output. The filter characteristic of the low-pass filter is variable and is set by a characteristics map KF1 in the memory device 13 (FIG. 1) to which the coolant temperature TCO has been fed. This characteristics map KF1 therefore supplies a coolant-temperature-range-dependent factor for controlling the low-pass filter. This means that the oil temperature gradient value at the low-pass filter output falls towards zero as the coolant temperature increases. The coolant temperature TCO is directly output as the model oil temperature value TOIL_MDL as per steps S4 and S5.

This oil temperature value TOIL_MDL is converted to a modeled oil temperature sensor value TOIL_MDL_SENS as per step S6, an averaging constant specific to the oil temperature sensor being additively or multiplicatively applied to the oil temperature value TOIL_MDL. This sensor-specific averaging constant is determined empirically and stored in the memory device 13. It is dependent, among other things, on the materials from which the oil temperature sensor, e.g. a thermocouple, is made. Converting the oil temperature value TOIL_MDL to the modeled oil temperature sensor value TOIL_MDL_SENS yields a temperature value which corresponds relatively accurately to the actual oil temperature value obtaining.

An oil temperature value TOIL_SENS is measured using the oil temperature sensor as per step S7. The modeled oil temperature sensor value TOIL_MDL_SENS is now compared to the oil temperature value TOIL_SENS measured by the oil temperature sensor, the difference between these two temperature values being calculated as per step S8. This differential value TOIL_SENS_DIF is then used as the input variable for a calculation step S9 indirectly or directly following the step of calculating the differential value TOIL_SENS_DIF, the value TOIL_SENS_DIF being additively or multiplicatively included as the control parameter for adjusting the oil temperature TOIL_MDL. An approximation of the modeled oil temperature value to the actual oil temperature value is therefore achieved by re-calculating the values TOIL_MDL_SENS and TOIL_SENS_DIF.

An approximation of the modeled oil temperature to the actual oil temperature and therefore sufficiently accurate determination of the oil temperature by means of the oil temperature model can be achieved by a one-off adjustment of the oil temperature TOIL_MDL using the control parameter. However, a sufficiently accurate value can also be achieved by repeatedly adjusting the oil temperature TOIL_MDL and calculating the differential value TOIL_SENS_DIF.

If the differential value TOIL_MDL_DIF exceeds a first temperature threshold value or if said differential value is below a second temperature threshold value, an oil temperature sensor malfunction is detected, the temperature threshold values being specifiable according to the operating conditions such as the mounting position of the oil temperature sensor.

As soon as only relatively small variations in the oil temperature sensor value TOIL_SENS occur for a specifiable time period of e.g. 10 minutes, a steady-state oil temperature condition is detected and the internal combustion engine is at normal running temperature.

Between the region in which the oil is heated up after startup of the internal combustion engine, defined as the dynamic region, and the steady-state region, there is a transitional region.

In this transitional region, the oil temperature value TOIL_MDL is fed into another characteristics map KF2 which outputs a gradient-dependent offset between the coolant temperature TCO and the oil temperature TOIL. This offset value is added to the oil temperature value TOIL_MDL and the oil temperature gradient value of the oil temperature model. However, the offset is only added when the coolant temperature TCO is above a threshold value. This threshold value will in most cases be close to the coolant pump switching threshold, thereby allowing for the fact that in an internal combustion engine the coolant pump is generally only operated above a certain minimum temperature.

Figure 3:
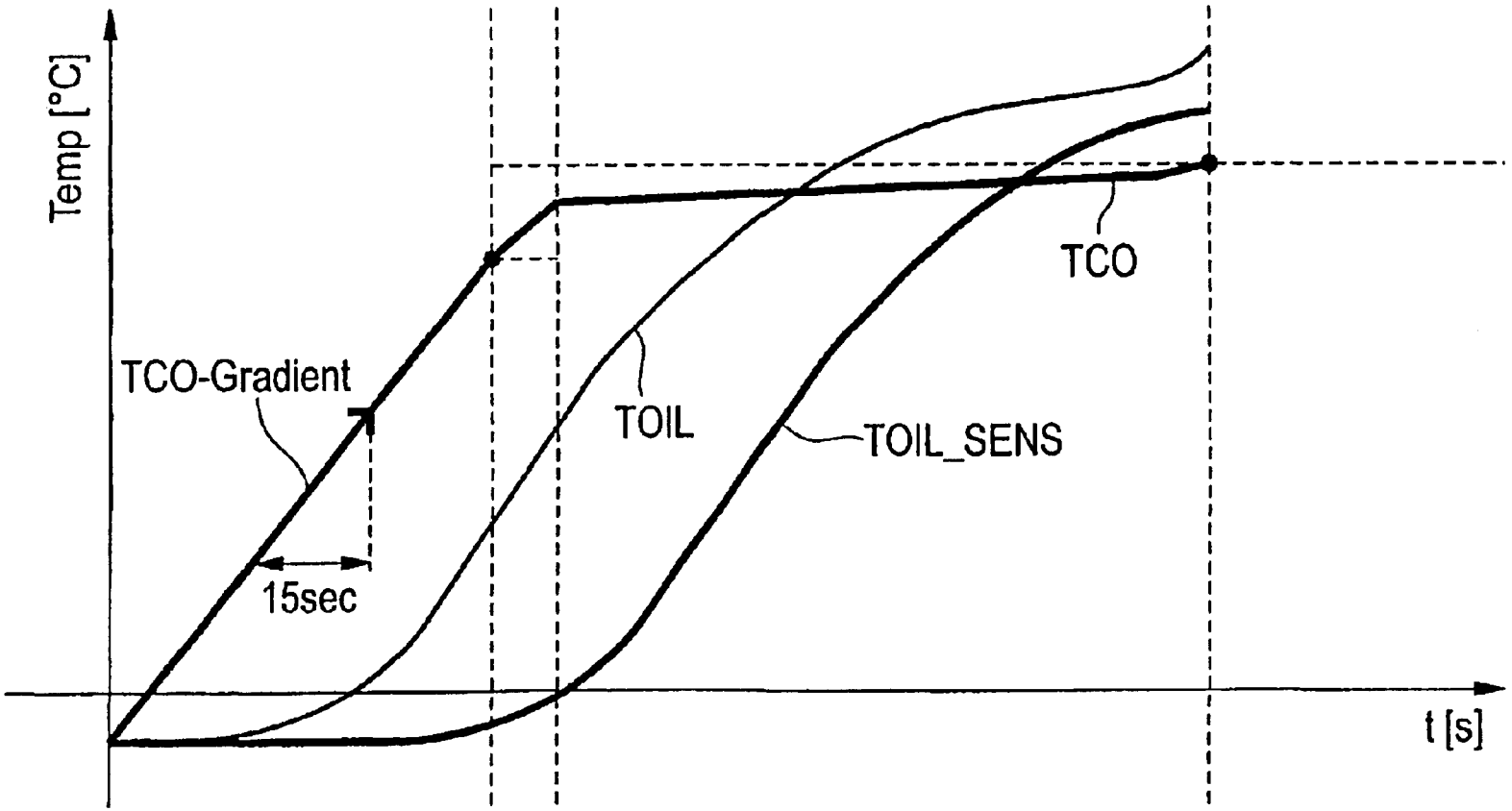
FIG. 3 shows the coolant and oil temperatures plotted as a function of time.

The graph in FIG. 3 plots the oil temperatures TOIL and TOIL_SENS and the coolant temperature TCO versus time. The curves show, at the start of the time axis, a dynamic region in which the temperatures increase. If the internal combustion engine's normal running temperature is reached, the curves flatten off and the steady-state condition obtains. In the dynamic region of the coolant temperature curve, the coolant temperature gradient (TCO gradient) is also plotted. In the dynamic warming-up region, the oil temperature TOIL_SENS of the sensor is approximately 30° C. below the actual oil temperature TOIL.

In addition to the coolant temperature TCO, the air mass flow MAF or the intake pipe pressure ps in the intake manifold 2 (FIG. 1) can be employed as a variable and used as a parameter characterizing the operating point of the internal combustion engine. In addition, in the case of internal combustion engines in which fuel is injected at high pressure directly into the cylinders, the effect of an excess air ratio λ can be taken into account as a parameter characterizing the operating point of the internal combustion engine, the excess air ratio λ specifying the ratio of the amount of air supplied for the combustion of a unit amount of the supplied fuel to the minimum amount of air required for complete combustion, a factor typically between 1 (stochiometric operation with λ=1) and 2 (layered, lean burn) being read out from another characteristics map KF3 as a function of the current excess air ratio λ value at which the internal combustion engine is being operated.

It can also be provided that, when a malfunction of the oil temperature sensor 14 (FIG. 1) is detected, a visual or audible signal is generated which can be used a warning, e.g. making the vehicle user aware of a defect.

Using the method, the oil temperature can therefore be relatively accurately determined even in the case of the dynamic rise in the oil temperature when an internal combustion engine is started up.

What is claimed is:

1. A method of determining the oil temperature in an internal combustion engine, comprising the steps of:

inputting at least one parameter characterizing the operating point of the internal combustion engine to a controller having an oil temperature model;

determining, by the oil temperature model in the controller, a modeled oil temperature sensor value based on the at least one parameter;

measuring an oil temperature value;

comparing the modeled oil temperature sensor value with the measured oil temperature value to calculate a differential value;

including the differential value as an input to the oil temperature model; and reiteratively determining, by the oil temperature model in the controller, another modeled oil temperature sensor value in a reiterative calculation cycle based on the at least one parameter and the differential value.

2. The method of claim 1, wherein said step of measuring an oil temperature value comprises using an oil temperature sensor.

3. The method of claim 2, further comprising the step of detecting an oil temperature sensor malfunction if the differential value exceeds a first temperature threshold value or is below a second temperature threshold value.

4. The method of claim 3, further comprising the step of at least one of generating a signal and placing an entry in a fault memory of a memory unit connected to the controller when an oil temperature sensor malfunction is detected, the signal being one of a visual signal and an audio signal.

5. The method of claim 1, wherein said differential value is additively or multiplicatively included in the oil temperature model.

6. The method of claim 1, wherein the at least one parameter includes at least one of coolant temperature, air mass flow, intake pipe pressure, and excess air ratio.

* * * * *